US010267258B2

(12) United States Patent
Maki et al.

(10) Patent No.: US 10,267,258 B2
(45) Date of Patent: Apr. 23, 2019

(54) METHOD OF HONING HIGH-POROSITY CYLINDER LINERS

(71) Applicant: Ford Global Technologies, LLC, Dearborn, MI (US)

(72) Inventors: Clifford E. Maki, New Hudson, MI (US); Timothy George Beyer, Troy, MI (US); Arup Kumar Gangopadhyay, Novi, MI (US); Hamed Ghaednia, West Bloomfield, MI (US); Larry Dean Elie, Ypsilanti, MI (US); James Maurice Boileau, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 143 days.

(21) Appl. No.: 15/369,013

(22) Filed: Dec. 5, 2016

(65) Prior Publication Data

US 2018/0156155 A1 Jun. 7, 2018

(51) Int. Cl.
*F02F 1/00* (2006.01)
*C23C 4/18* (2006.01)
(Continued)

(52) U.S. Cl.
CPC ..... *F02F 1/004* (2013.01); *B24B 33/02* (2013.01); *C23C 4/134* (2016.01); *C23C 4/18* (2013.01);
(Continued)

(58) Field of Classification Search
CPC ..... F02F 1/004; F02F 1/08; F02F 1/16; F02F 2200/00; B24B 33/02; C23C 4/134; C23C 4/18
See application file for complete search history.

(56) References Cited

U.S. PATENT DOCUMENTS 4,980,996 A 1/1991 Klink et al.
5,344,494 A 9/1994 Davidson et al.
(Continued)

FOREIGN PATENT DOCUMENTS

DE 19711756 A1 9/1998

OTHER PUBLICATIONS

Yuan, Zhiwei Guochengqing et al., Study on Influence of Cylinder Liner Surface Texture on Lubrication Performance for Cylinder Liner-Piston Ring Components, vol. 51, Issue 1, Jul. 2013, pp. 9-23.

*Primary Examiner* — Jacob Amick
(74) *Attorney, Agent, or Firm* — Ray Coppiellie; Brooks Kushman P.C.

(57) ABSTRACT

Methods of honing a surface are disclosed. The method may include spraying a coating having an initial average bulk porosity onto an engine bore wall and honing the coating to create an intermediate honed surface. The method may then include cleaning the intermediate honed surface and honing the intermediate honed surface with a cutting force of, for example, 110-130 kgf after the cleaning step. This may create a honed surface having an average porosity greater than the initial average bulk porosity. The methods may create a honed surface having a porosity that is more porous than the initially sprayed coating. The increased porosity of the honed surface may allow for increased oil retention in, for example, engine bores.

20 Claims, 9 Drawing Sheets

(51) Int. Cl.
*C23C 4/134* (2016.01)
*B24B 33/02* (2006.01)

(52) U.S. Cl.
CPC ..... *F02F 2200/00* (2013.01); *F02F 2200/06* (2013.01)

(56) References Cited

U.S. PATENT DOCUMENTS

| | | | | |
|---|---|---|---|---|
| 5,380,564 | A | 1/1995 | VanKuiken, Jr. et al. | |
| 5,441,439 | A | 8/1995 | Grimm et al. | |
| 5,592,927 | A | 1/1997 | Zaluzec et al. | |
| 5,820,938 | A | 10/1998 | Pank et al. | |
| 5,932,026 | A | 8/1999 | Trampusch | |
| 6,041,749 | A | 3/2000 | Lübbing | |
| 6,379,754 | B1 | 4/2002 | Schlegel et al. | |
| 6,701,882 | B2 | 3/2004 | Barbezat | |
| 7,685,991 | B2 | 3/2010 | Cumming et al. | |
| 8,220,124 | B1 | 7/2012 | Morasch et al. | |
| 8,286,468 | B2 | 10/2012 | Nishimura et al. | |
| 8,726,874 | B2 | 5/2014 | Whitbeck et al. | |
| 2010/0288222 | A1 | 11/2010 | Urabe et al. | |
| 2012/0132069 | A1 | 5/2012 | Roh | |
| 2013/0131824 | A1 | 5/2013 | Meehan et al. | |
| 2013/0340700 | A1 | 12/2013 | Donahue | |
| 2013/0343700 | A1 | 12/2013 | Kolesar | |
| 2014/0069272 | A1* | 3/2014 | Cryer | B24B 33/02 92/169.1 |
| 2015/0027398 | A1* | 1/2015 | Ernst | F02F 1/00 123/193.2 |
| 2017/0175668 | A1 | 6/2017 | Schepak et al. | |
| 2017/0260926 | A1 | 9/2017 | Maki et al. | |
| 2018/0058370 | A1 | 3/2018 | Amano | |

* cited by examiner

METHOD OF HONING HIGH-POROSITY CYLINDER LINERS

RESEARCH OR DEVELOPMENT

The invention was made with Government support under Contract No. DE-EE0006901 awarded by the Department of Energy. The Government has certain rights to the invention.

TECHNICAL FIELD

The present disclosure relates to method of honing high-porosity cylinder liners, for example, for engine blocks.

BACKGROUND

Engine blocks (cylinder blocks) may include one or more cylinder bores that house pistons of an internal combustion engine. Engine blocks may be cast, for example, from cast iron or aluminum. Aluminum is lighter than cast iron, and may be chosen in order to reduce the weight of a vehicle and improve fuel economy. Aluminum engine blocks may include a liner, such as a cast iron liner. If liner-less, the aluminum engine block may include a coating on the bore surface. Cast iron liners generally increase the weight of the block and may result in mismatched thermal properties between the aluminum block and the cast iron liners. Liner-less blocks may receive a coating (e.g., a plasma coated bore process) to reduce wear and/or friction.

SUMMARY

In at least one embodiment, a method is provided. The method may include spraying a coating having an initial average bulk porosity onto an engine bore wall; honing the coating to create an intermediate honed surface; cleaning the intermediate honed surface; and honing the intermediate honed surface with a cutting force of 110-130 kgf after the cleaning step to create a honed surface having an average porosity greater than the initial average bulk porosity.

Honing the intermediate honed surface may create a honed surface having an average porosity that is at least 2% or at least 5% greater than the initial average bulk porosity. The cleaning step may generate nucleation sites in the intermediate honed surface and honing the intermediate honed surface after the cleaning step may remove material from the nucleation sites to create new pores. The cleaning step may include spraying a pressurized liquid or a solid onto the intermediate honed surface or brushing the intermediate honed surface. In one embodiment, the cutting force is 115-125 kgf or about 120 kgf. In another embodiment, the initial average bulk porosity is from 0.1-3% and the average porosity of the honed surface is 5-20%.

In at least one embodiment, a method is provided. The method may include spraying a coating comprising a plurality of particles onto an engine bore wall, the coating having an initial average bulk porosity; honing the coating to create an intermediate honed surface; cleaning the intermediate honed surface to remove debris from pores in the intermediate honed surface and to loosen a portion of the particles in the coating; and honing the intermediate honed surface after the cleaning step to remove particles loosened in the cleaning step and create a honed surface having an average porosity greater than the initial average bulk porosity.

Honing the intermediate honed surface may create a honed surface having an average porosity that is at least 2% or at least 5% greater than the initial average bulk porosity. In one embodiment, the cleaning step includes spraying a pressurized liquid onto the intermediate honed surface. In another embodiment, the cleaning step includes spraying a solid material onto the intermediate honed surface. In another embodiment, the cleaning step includes mechanically brushing the intermediate honed surface. The honing of the intermediate honed surface may be performed using a cutting force of 110-130 kgf, such as 115-125 kgf. In one embodiment, the initial average bulk porosity is from 0.1-3% and the average porosity of the honed surface is 5-20%.

In at least one embodiment, an engine block is provided. The engine block may include a body including at least one cylindrical engine bore wall having a coating thereon, the coating having a bulk region having a bulk average porosity and a surface region having a surface average porosity; wherein the surface average porosity is at least 3% greater than the bulk average porosity.

In one embodiment, the surface average porosity is at least 5% greater than the bulk average porosity. In another embodiment, the bulk average porosity is from 0.1-3% and the surface average porosity is 5-20%.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
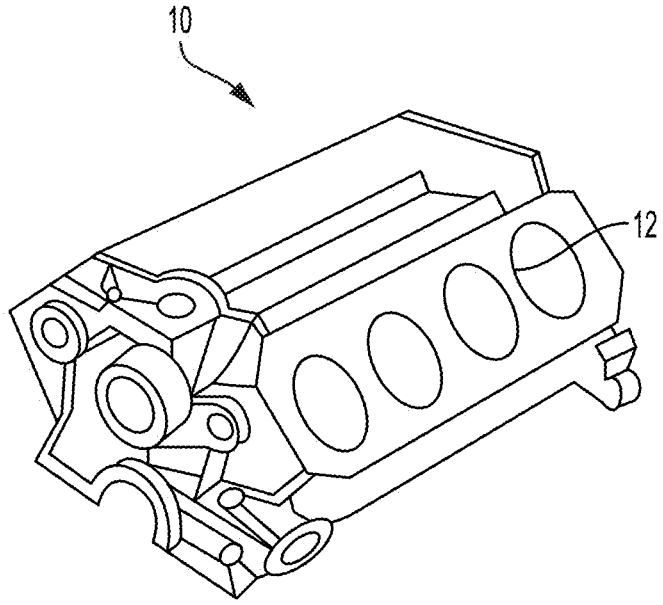
FIG. 1 is a schematic perspective view of an engine block.
Figure 2:
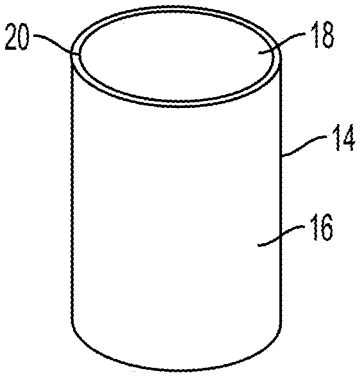
FIG. 2 is a perspective view of a cylinder liner, according to an embodiment.

With reference to FIG. 1, an engine or cylinder block 10 is shown. The engine block 10 may include one or more cylinder bores 12, which may be configured to house pistons of an internal combustion engine. The engine block body may be formed of any suitable material, such as aluminum, cast iron, magnesium, or alloys thereof. In at least one embodiment, the engine block 10 is a liner-less engine block. In these embodiments, the bores 12 may have a coating thereon. In at least one embodiment, the engine block 10 may include cylinder liners 14, such as shown in FIG. 2, inserted into or cast-in to the bores 12. The liners 14 may be a hollow cylinder or tube having an outer surface 16, an inner surface 18, and a wall thickness 20.

If the engine block parent material is aluminum, then a cast iron liner or a coating may be provided in the cylinder bores to provide the cylinder bore with increased strength, stiffness, wear resistance, or other properties. For example, a cast iron liner may cast-in to the engine block or pressed into the cylinder bores after the engine block has been formed (e.g., by casting). In another example, the aluminum cylinder bores may be liner-less but may be coated with a coating after the engine block has been formed (e.g., by casting). In another embodiment, the engine block parent material may be aluminum or magnesium and an aluminum or magnesium liner may be inserted or cast-in to the engine bores. Casting in of an aluminum liner into an aluminum engine block is described in U.S. application Ser. No. 14/972,144 filed Dec. 17, 2015, now U.S. Pat. No. 10,132,267 issued on Nov. 20, 2018, the disclosure of which is hereby incorporated in its entirety by reference herein.

Accordingly, the bore surface of the cylinder bores may be formed in a variety of ways and from a variety of materials. For example, the bore surface may be a cast-iron surface (e.g., from a cast iron engine block or a cast-iron liner) or an aluminum surface (e.g., from a liner-less Al block or an Al liner). The disclosed variable coating may be applied to any suitable bore surface, therefore, the term bore surface may apply to a surface of a liner-less block or to a surface of a cylinder liner or sleeve that has been disposed within the cylinder bore (e.g., by interference fit or by casting-in).

Figure 3:
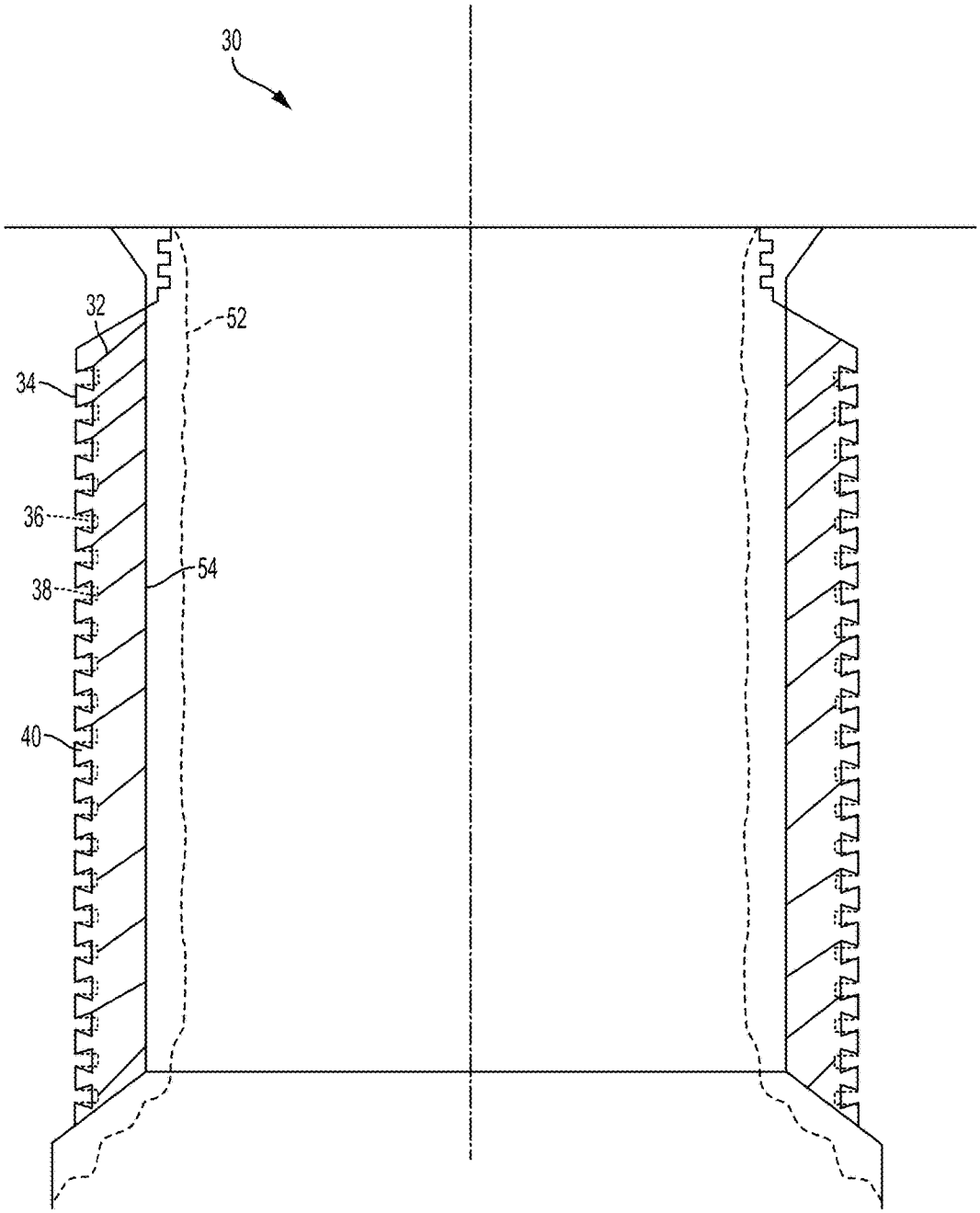
FIG. 3 is a schematic cross-section of a coated engine bore, according to an embodiment.

With reference to FIG. 3, a cylinder bore 30 having a coating 32 is disclosed. While a cylinder bore is shown and described, the present disclose may apply to any article comprising a body including at least one sliding surface wall having a longitudinal axis. Prior to applying the coating 32, the bore surface 34 may be roughened. Roughening the bore surface 34 may improve the adhesion or bonding strength of the coating 32 to the bore 30. The roughening process may be a mechanical roughening process, for example, using a tool with a cutting edge, grit blasting, or water jet. Other roughening processes may include etching (e.g., chemical or plasma), spark/electric discharge, or others. In the embodiment shown, the roughening process may be multiple steps. In the first step, material may be removed from the bore surface 34 such that projections 36 are formed (in dashed lines). In the second step, the projections may be altered to form overhanging projections 38 having undercuts 40. The projections may be altered using any suitable process, such as rolling, cutting, milling, pressing, grit blasting, or others.

The coating 32 may be applied to the roughed bore surface. In one embodiment, the coating may be a sprayed coating, such as a thermally sprayed coating. Non-limiting examples of thermal spraying techniques that may be used to form the coating 32 may include plasma spraying, detonation spraying, wire arc spraying (e.g., plasma transferred wire arc, or PTWA), flame spraying, high velocity oxy-fuel (HVOF) spraying, warm spraying, or cold spraying. Other coating techniques may also be used, such as vapor deposition (e.g., PVD or CVD) or chemical/electrochemical techniques. In at least one embodiment, the coating 32 is a coating formed by plasma transferred wire arc (PTWA) spraying.

An apparatus for spraying the coating 32 may be provided. The apparatus may be a thermal spray apparatus including a spray torch. The spray torch may include torch parameters, such as atomizing gas pressure, electrical current, plasma gas flow rate, wire feed rate and torch traverse speed. The torch parameters may be variable such that they are adjustable or variable during the operation of the torch. The apparatus may include a controller, which may be programmed or configured to control and vary the torch parameters during the operation of the torch. As described in commonly owned application U.S. application Ser. No. 15/064,903, filed Mar. 9, 2016, the disclosure of which is hereby incorporated in its entirety by reference herein, the controller may be programmed to vary the torch parameters to adjust the porosity of the coating 32, in a longitudinal and/or depth direction. The controller may include a system of one or more computers which can be configured to perform particular operations or actions by virtue of having software, firmware, hardware, or a combination thereof installed on the system that in operation causes or cause the system to perform the disclosed actions. One or more computer programs can be configured to perform particular operations or actions by virtue of including instructions that, when executed by the controller, cause the apparatus to perform the actions.

The coating 32 may be any suitable coating that provides sufficient strength, stiffness, density, wear properties, friction, fatigue strength, and/or thermal conductivity for an engine block cylinder bore. In at least one embodiment, the coating may be an iron or steel coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to irons or steels, and may be formed of, or include, other metals or non-metals. For example, the coating may be a ceramic coating, a polymeric coating, or an amorphous carbon coating (e.g., DLC or similar). The coating type and composition may therefore vary based on the application and desired properties. In addition, there may be multiple coating types in the cylinder bore 30. For example, different coating types (e.g., compositions) may be applied to different regions of the cylinder bore (described in more detail below) and/or the coating type may change as a function of the depth of the overall coating (e.g., layer by layer).

In general, the process of applying the coating 32 and finalizing the bore dimensions and properties may include several steps. First, the bore surface may be prepared to receive the coating. As described above, the bore surface may be a cast engine bore or a liner (cast-in or interference fit). The surface preparation may include roughening and/or washing of the surface to improve the adhesion/bonding of the coating. Next, the deposition of the coating may begin. The coating may be applied in any suitable manner, such as spraying. In one example, the coating may be applied by thermal spraying, such as PTWA spraying. The coating may be applied by rotational spraying of the coating onto the bore surface. The spray nozzle, the bore surface, or both may be rotated to apply the coating. As described in U.S. application Ser. No. 15/064,903, the deposition parameters may be adjusted (e.g., by a controller) to produce varying levels of porosity in the coating. The adjustments may be made while the coating is being applied or the application may be paused to adjust the parameters. Additional layers of the coating may be applied using the same or further adjusted deposition parameters.

After the coating is applied, it may be honed to a final bore diameter according to specified engine bore dimensions. In some embodiments, an optional mechanical machining operation, such as boring, cubing, etc., may be performed prior to honing in order to reduce the amount of stock removal during honing. In general, the honing process includes inserting a rotating tool having abrasive particles into the cylinder bore to remove material to a controlled diameter. The abrasive particles may be attached to individual pieces called honing stones, and a honing tool may include a plurality of honing stones. The honing process may include one or more honing steps. If there are multiple honing steps, the parameters of the honing process, such as grit size and force applied, may vary from step to step. In the embodiments shown in FIG. 3, the coating 32 may initially be deposited to a thickness 52, shown in a dashed line. The honing process may remove material from the coating 32 and provide a highly cylindrical bore wall 54 having the final bore diameter. As described herein, the coating surface for the purpose of porosity may be the surface that results from the honing process, not the initial surface after deposition (e.g., the bore wall 54, not the initial thickness 52).

Figure 4:
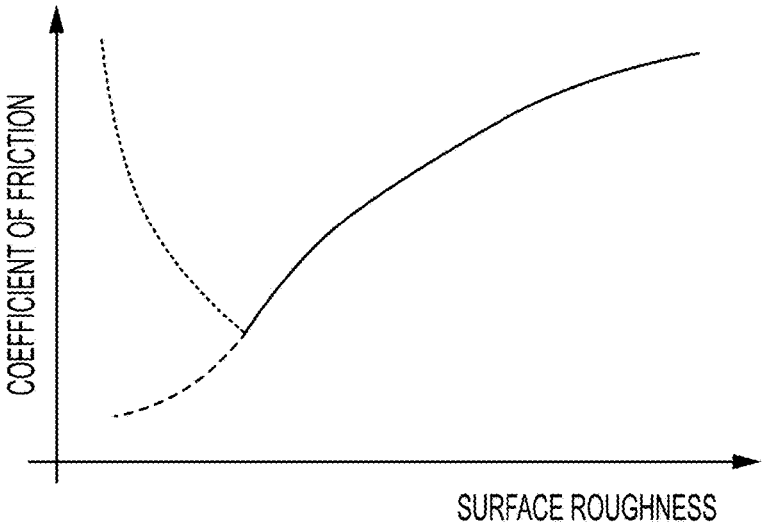
FIG. 4 is a schematic plot showing the impact of surface roughness on engine bore friction.

It has been discovered that the honing process may have a significant impact on the resulting surface porosity of the coating 32. With reference to FIG. 4, it has been found that there is generally an inflection point in the coefficient of friction with increasing surface roughness of the honed bore wall surface. At very low surface roughness, there is insufficient oil retention and the coefficient of friction is relatively high. As the surface roughness increases, the oil may be retained in the valleys of the surface and the coefficient of friction improves (lowers). At a certain point, the roughness of the surface overcomes the oil retention benefits and the coefficient of friction increases again due to increased asperity to asperity interaction. Accordingly, there is an optimum or sweet spot in surface roughness that provides the lowest coefficient of friction (other factors held constant). Having sufficient pores one can hone the surface to very smooth roughness without losing oil retention.

Figure 5:
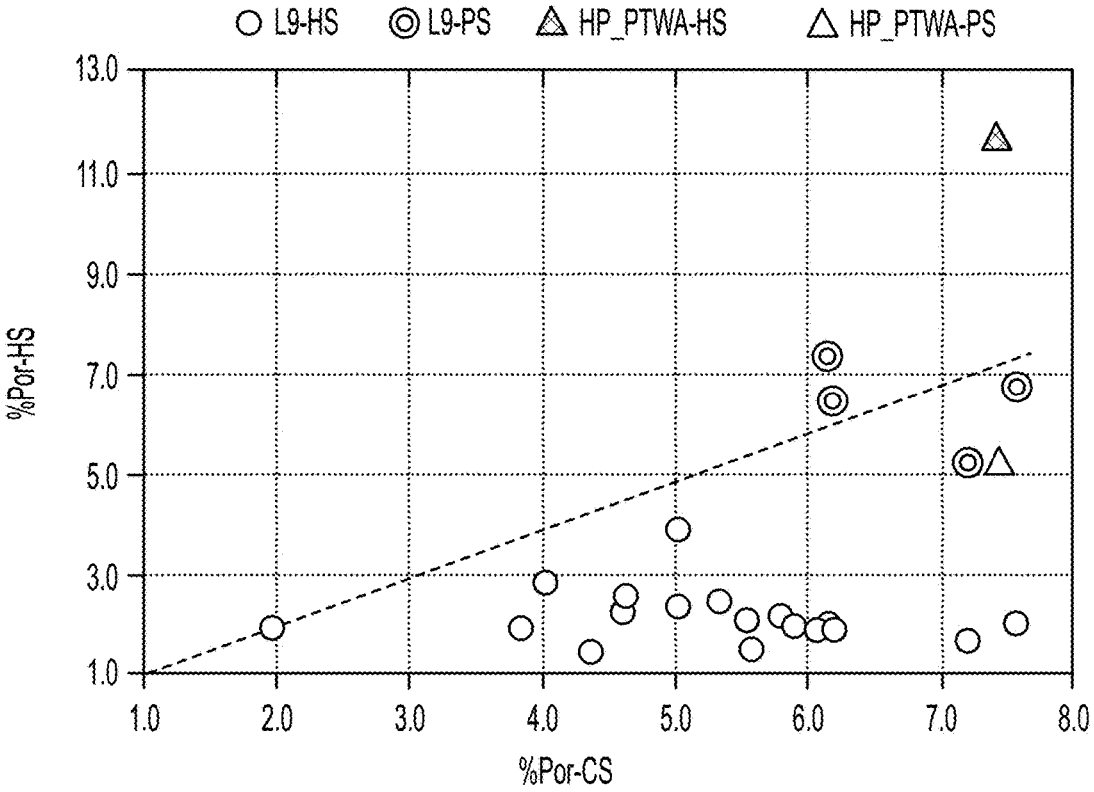
FIG. 5 is a plot of experimental data showing the porosity of an engine bore coating in cross-section and on a honed surface.

With reference to FIG. 5, as described in U.S. application Ser. No. 15/064,903, deposition parameters may be adjusted to produce varying levels of porosity in the bore coating. However, despite the ability to accurately control the porosity in the bulk of the coating (indicated as %-Por-CS, for cross-section), the porosity levels at a honed surface (HS) do not generally reach the same levels as the bulk. But, if the surface is polished (PS) instead of honed, then the surface porosity is similar to the bulk porosity. This indicates that the conventional honing process is at least partially the reason for the low surface porosity compared to the bulk.

Figure 6:
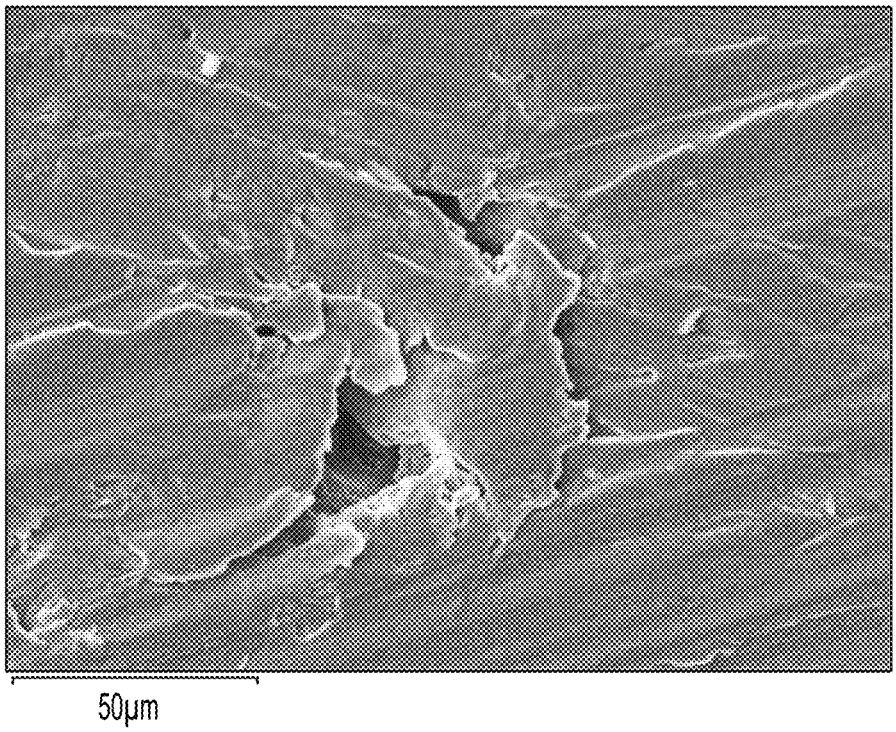
FIG. 6 is a micrograph of a pore that has been smeared over during a honing process.

With reference to FIG. 6, an example is shown of how conventional honing processes can reduce surface porosity on a honed surface. During the honing process, material that is removed from the coated bore surface or a burr or edge of a pore may be smeared over the pore surface or may fill in the pore. This may result in a lower surface porosity and significantly reduce the oil retention capability of the pore. Accordingly, changes to the honing process may be one approach to improving the surface porosity of the honed surface.

It has been discovered that a combination of a cleaning process and a particular final honing process may maintain the bulk porosity at the honed surface, and may even increase the honed surface porosity compared to the bulk porosity in some embodiments. As used herein, the honed surface may be a region in the coating that includes the surface of the coating and a relatively small depth beneath the surface, for example, up to 5 μm, 10 μm, 25 μm, or 50 μm beneath the surface. It has been found that the porosity of the honed surface can generally be described by two types of pores, which may be referred to as primary and secondary pores. Primary pores may be those that are generated during the coating process (e.g., spraying). For example, the type of porosity generally referred to in U.S. application Ser. No. 15/064,903. These pores (e.g., porosity and size) may be generally controlled by the coating parameters. Secondary pores may be those that are created or generated after the coating has been deposited. It has been found that the disclosed cleaning and honing combination is one way to generate secondary pores.

However, secondary pores may only be created under certain circumstances. One parameter that has been found to be important for secondary pore generation is the honing force of the final honing process. As described above, the overall honing process may include multiple honing steps. It has been discovered that the honing force during the final honing step may have a significant impact on the final honed surface porosity. If the force is too low, there may be insufficient force to remove material from the coating surface to create the secondary pores. If the force is too high, the surface of the coating may be crushed and any pores formed may be closed-off, thereby reducing or eliminating their ability to retain oil.

Figure 7:
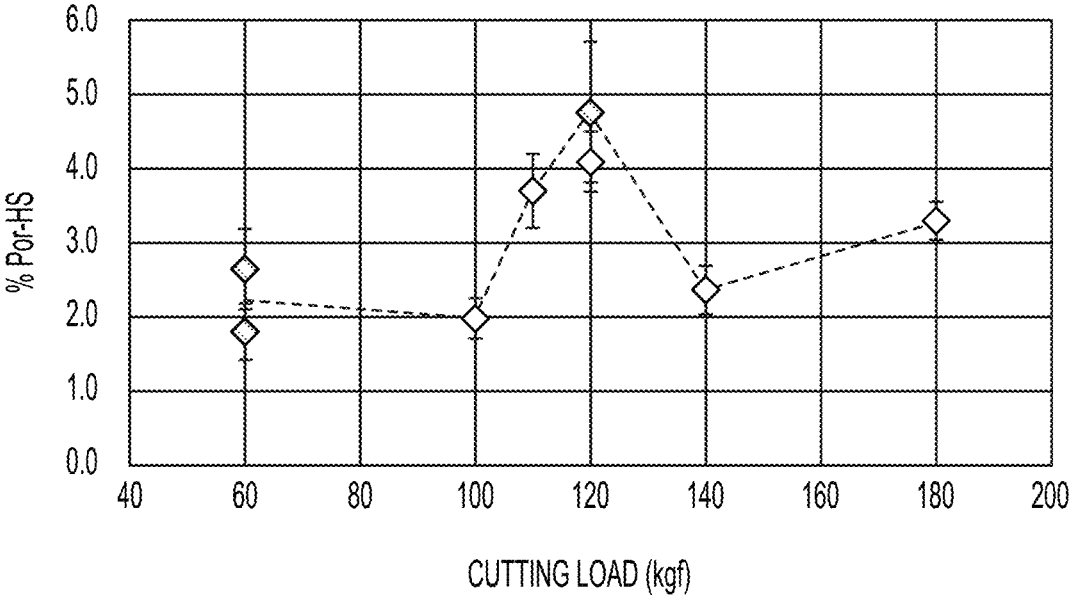
FIG. 7 is a plot of experimental data showing the impact of cutting load on honed surface porosity.

With reference to FIG. 7, experimental data is shown for a PTWA thermal spray coating of 1010 steel. As shown, the honed surface porosity (% Por-HS) is relatively low in the low and high cutting force regions, similar to the results in FIG. 5. However, in the range of about 110 to 130 kgf, there is a spike in the honed surface porosity to about double the surrounding values. Without being held to any particular theory, it is believed that this force is sufficient to remove material from the coating surface but not so high that it crushes the coating or closes off the pore that is created. While the data shown is for a 1010 steel coating, it has been found that the same cutting load (honing force) of 110-130 kgf is similarly effective across other coatings, such as other steel coatings. Accordingly, in at least one embodiment, the disclosed method may include a final honing step in which the honing force (cutting load) is from 110 to 130 kgf, or any sub-range therein, such as 115 to 125 kgf or about 120 kgf (e.g., ±3 kgf).

In addition to the discovered effective honing force, above, it has also been discovered that a cleaning process may further improve the porosity of the honed surface when performed prior to the final honing step. The cleaning process may include performing one or more cleaning passes of the bore coating surface. In one embodiment, the cleaning process may include a high-pressure water spray. The spray may be controlled into a spray pattern, such as a fan spray pattern (e.g., a substantially 2D spray pattern). Other cleaning methods that may be suitable include ice blasting (e.g., water- or $CO_2$-based), brushing, or a very fine abrasive media. These methods are examples, however, and not intended to be limiting.

The cleaning process may remove debris or burrs that are present from previous machining operations, such as previous honing steps or a boring operation. Accordingly, loose material that is present in the pores of the coating may be removed to expose the pores and allow them to retain oil. However, it has been discovered that the cleaning process may perform another function—creating nucleation sites for pore generation in the later final honing step. During certain coating processes, particles of the coating material may be accelerated towards the bore surface, for example, in the form of solid particles (cold spray) or melted globules (hot spray). These particles may build up on each other to form a substantially continuous coating. The particles may generally deform or coalesce to form a relatively uniform coating, however, some particles may remain more discrete or weakly bonded to the coating than others. In addition, in certain areas the layers of the coating may not be completely adhered or adhered as strongly as in other areas. These particles and areas may be potential sites for new pore generation during the honing process (e.g., nucleation sites).

Figure 8:
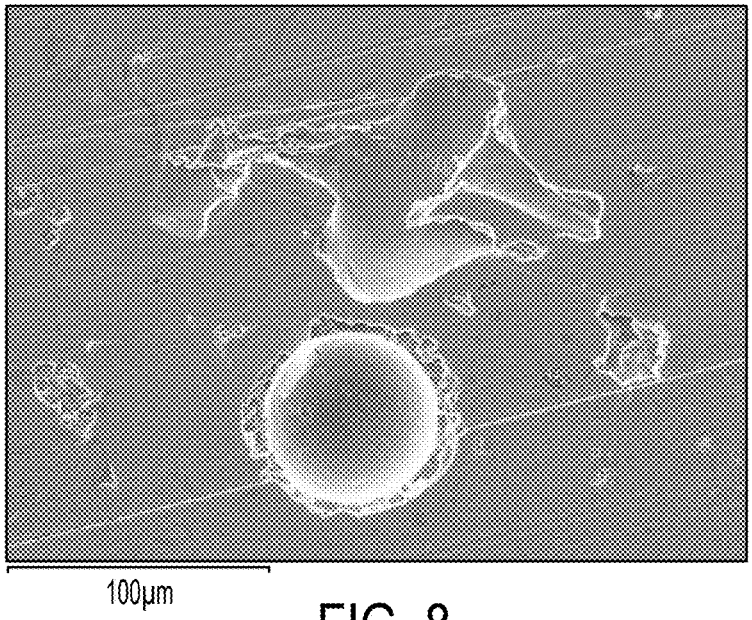
FIG. 8 is a micrograph showing two types of pores that may be generated by the disclosed process.

With reference to FIG. 8, it has been found that the cleaning process may cause de-bonding or delamination of these particles or layers, respectively, or may impart residual stresses in the coating at or near the particles. A subsequent honing process may then remove (e.g., pull out) at least a portion of the loosened or stressed particles (bottom) or delaminated layers (top) to form secondary pores. Accordingly, the cleaning process may perform at least two functions: 1) remove existing debris and burrs from the coating surface and 2) generate nucleation sites on the coating surface that may allow the subsequent honing process to remove particles or chips from the coating surface that would have otherwise remained attached. The cleaning process may therefore allow for the honed surface to not only have a similar porosity compared to the bulk of the coating, it may have an increased porosity due to the additionally generated pores. In some embodiments, the cleaning process (or a similar cleaning process) may be repeated after the final honing process to clear out any final debris, remove any burrs, or clean out any other loose material from the bore surface or within the pores.

Accordingly, in at least one embodiment, the disclosed method of surface finishing a coated bore surface may include first a cleaning process and then a final honing process after the cleaning process. The cleaning process, such as a water jet, ice-blasting, or brushing, may remove debris, but also loosen or introduce stress into particles or local areas of the coating. After the cleaning process, a final honing step may be performed, which may use a certain honing force for optimum pore creation. In one embodiment, the honing force may be from 110 to 130 kgf, or any sub-range therein. The final honing process may remove or pull out the particles loosened by the cleaning process and/or may remove or pull out areas of the coating that were delaminated by the cleaning process. While either process may separately improve the porosity of the honed surface compared to conventional honing practices, the combination of the two processes provides a synergistic effect that may increase the porosity of the honed surface compared to the bulk of the coating.

Figure 9:
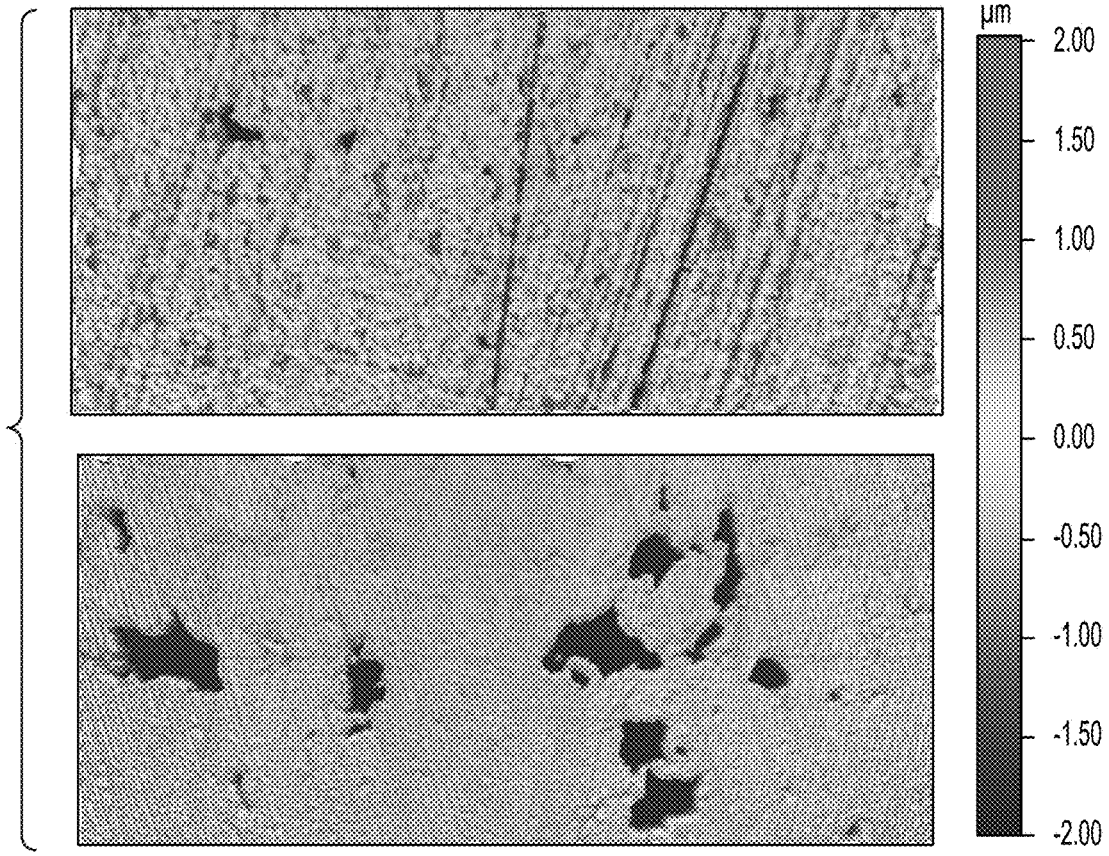
FIG. 9 is a comparison of surface topography for a conventionally honed surface (top) and a surface created by the disclosed process (bottom), according to an embodiment.

With reference to FIG. 9, a comparison of two example surface finishes is shown. The top example is the surface of a thermally sprayed coating that was finished using a conventional honing process (e.g., multiple steps with progressively finer grit). Conventional honing results in the shown cross-hatch pattern having both a plurality of "peaks" and "valleys" (highs and lows). These valleys may retain oil, however, the peaks and valleys increase the surface roughness, as described with reference to FIG. 4. In comparison, the bottom example is the surface of a thermally sprayed coating that was finished according to the disclosed process (cleaning and final hone). As shown, there are several wide pores that are similar to valleys and which may retain oil. However, the rest of the surface is substantially smooth, and generally without any of the peaks from the top example (e.g., substantially no peaks of 1 μm or higher). Accordingly, the disclosed process may generate a very smooth surface but may also have very good oil retention in the pores.

The disclosed cleaning and honing process may be applied to the entire bore surface or the entire bore surface that makes contact with the piston (e.g., top dead center to bottom dead center). In other embodiments, the cleaning and honing process may be applied to only certain portions of the bore surface and the remaining portions may be surface finished using conventional techniques. In other embodiments, variations of the cleaning and/or honing process may be applied to different areas of the bore surface. Accordingly, the surface porosity of the honed surface may be tailored to the oil retention needs or environment in different locations of the cylinder bore. In addition, the bulk coating porosity may be tailored to different locations of the cylinder bore, as described in U.S. application Ser. No. 15/064,903. Therefore, the bulk porosity and honed surface porosity of the coating may each be tailored to different locations of the cylinder bore to provide improved oil retention or lubrication condition in each location.

For example, if it is desired to have a portion of the cylinder bore have a low honed surface porosity, a relatively low porosity coating may be applied and a conventional honing process may be used that does not increase the porosity of the surface. If a moderate or intermediate porosity portion is desired, there may be several options. In one example, a relatively low porosity coating may be applied and the disclosed cleaning and honing process may be used to increase the honed surface porosity from low to moderate. In another example, a moderate porosity coating may be applied and a conventional honing process may be used that does not increase the porosity. If a relatively high porosity coating is desired, there may again be several options. In one example, a low or moderate porosity coating may be applied and the disclosed cleaning and honing process may be used to increase the honed surface porosity from low or moderate to high. In another example, a high porosity coating may be applied and a conventional honing process may be used that does not increase the porosity. If a very high porosity coating is desired, one example may include applying a moderate or high porosity coating and using the disclosed cleaning and honing process to increase the honed surface porosity from moderate or high to very high. Accordingly, the type of coating and the type of honing process may be mixed and matched to generate a coating having a desired honed surface porosity. The examples given above are not intended to be limiting, one of skill in the art will, based on the present disclosure, appreciate that other combinations may be used.

In addition the different combinations of the coating properties and conventional vs. the disclosed honing process described above, variations of the disclosed honing process may also be used to adjust the honed surface porosity. For example, the disclosed honing process may include one or more cleaning passes prior to the final honing step. As described above, the cleaning step may include processes such as high pressure liquid (e.g., water) spraying, ice blasting, or mechanical cleaning (e.g., brushing). In addition, it has been described that the cleaning step may facilitate increased porosity at the surface by loosening or adding stress to the surface, thereby allowing the final honing step to remove the loosened or stressed material.

Accordingly, increasing or decreasing the intensity of the cleaning process may affect the degree or amount of loosening or stressing of the coating surface. In one embodiment, increasing the intensity of the cleaning process may increase the amount of loosening or stressing, and vice versa. For example, if a high pressure water jet is used, increasing the pressure of the jet may increase the intensity of the cleaning pass. Similarly, if mechanical cleaning is used, the force applied may be increased, the speed of the cleaning may be increased, or other parameters that make the cleaning more intense. Another way to increase or decrease the intensity may be to vary the number of cleaning passes in the cleaning process. Additional cleaning passes may cause more loosening or stressing of the coating, while fewer may reduce it.

As described above, the honing force in the disclosed honing process may be between 110 and 130 kgf. However, other parameters of the honing process may be varied to affect the honed surface porosity. For example, the grit size of the honing stones may be adjusted to be either finer (smaller) or coarser (larger). A coarser grit may remove more material and may lead to increased pull-out of particles or delamination; however care must be taken as the volume fraction of porosity on the honed surface may be a function of factors such as the coating's microstructure and mechanical properties as well as the hone stone size and honing forces used in the machining process.

Figure 10:
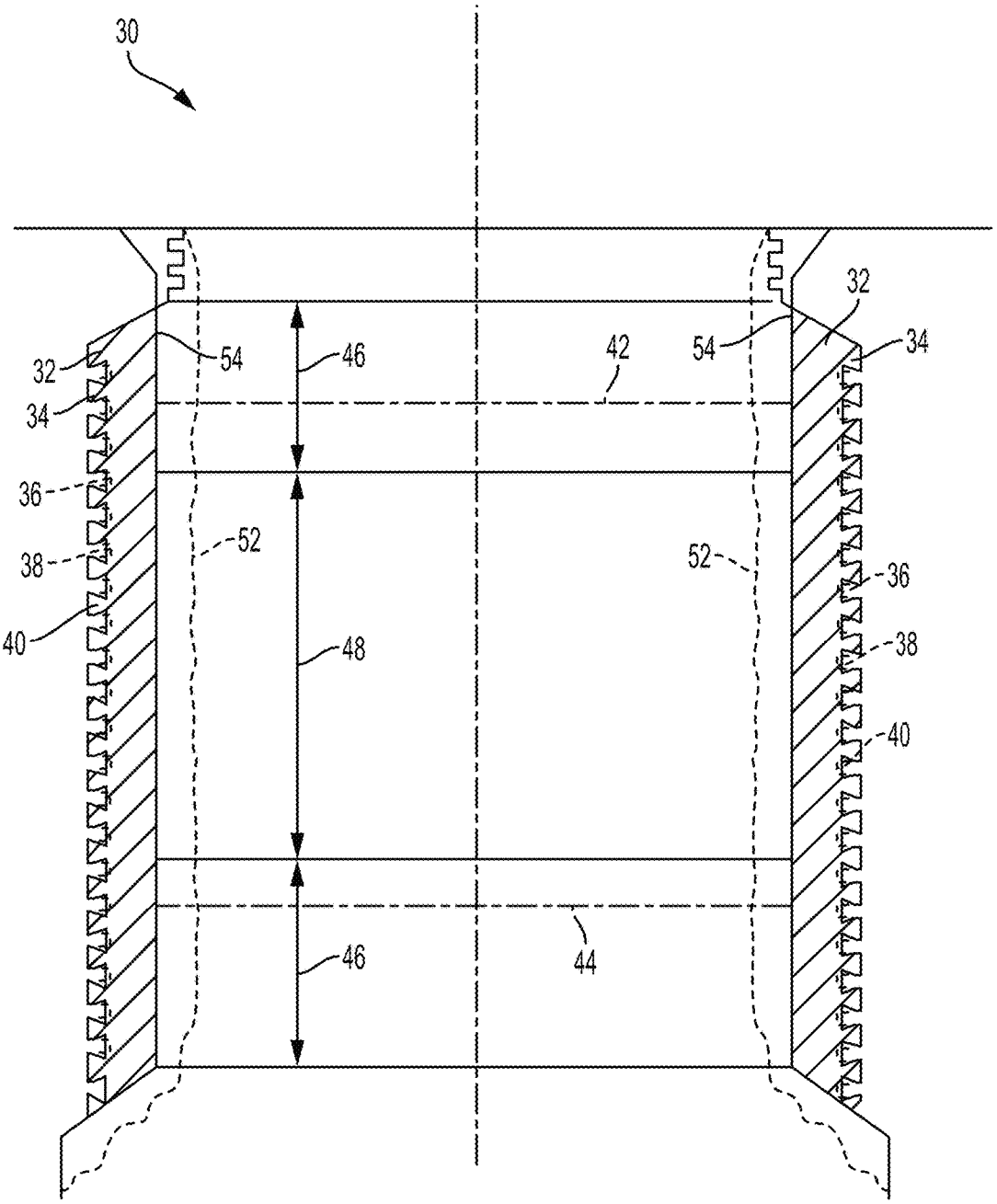
FIG. 10 is a schematic cross-section of a coated engine bore having variable honed surface porosity along a vertical axis of the engine bore, according to an embodiment.

With reference to FIG. 10, a schematic example of a cylinder bore 30 is shown. During the stroke of the piston inside the cylinder bore, the friction condition may change based on the crank angle or the location and/or speed of the piston. For example, when the piston is at or near the top dead center (TDC) 42 and/or the bottom dead center (BDC) 44, the speed of the piston may be small or zero, at the very top and bottom of the stroke (e.g., near crank angles of 0 and 180 degrees). When the piston is at or near TDC 42 or BDC 44, the friction condition may be boundary friction, wherein there is asperity contact between the piston and the bore surface (or coating surface, when coated). When the piston is moving at relatively high speeds in a middle section of the bore length/height (e.g., crank angle between about 35 to 145 degrees), the friction condition may be hydrodynamic friction, wherein there is little or no asperity contact. When the piston is between these two regions (e.g., crank angle between about 10 to 35 or about 145 to 170), either moving toward or away from TDC 42 or BDC 44, the piston speed is relatively moderate and the friction condition may be mixed boundary and hydrodynamic friction (e.g., some asperity contact). Of course, the crank angles disclosed herein are examples, and the transition to different friction conditions (e.g., boundary to mixed) will depend on the speed of the engine, the engine architecture, and other factors.

Accordingly, the lubrication properties or requirements may be different in different regions of the cylinder bore 30. In at least one embodiment, the honed surface porosity of the coating 32 may vary along the height of the bore 30. As used herein, honed surface porosity may refer to the porosity of the surface of the coating after the final honing process is completed. As described above, the disclosed combined cleaning and honing process may increase the porosity of the honed surface above the bulk porosity of the coating (e.g., by pull-out of particles or delamination). The pores in the honed surface may act as reservoirs to hold oil/lubricant, thereby providing lubrication in severe operating conditions or improving lubricant film thickness. Therefore, regions having different levels of honed surface porosity may have different effects on the lubrication of the cylinder bore 30. In at least one embodiment, there may be at least two different honed surface porosity levels along the height of the bore 30. There may be a relatively low honed surface porosity region 46 and a relatively high honed surface porosity region 48. In the embodiment shown in FIG. 10, there may be two low honed surface porosity regions 46 and a high honed surface porosity region 48 in between (e.g., separating the regions 46).

One low honed surface porosity region 46 may extend over a height of the cylinder bore 30 that includes the TDC 42. The region 46 may extend below the TDC 42 by a certain amount. For example, the region 46 may cover a certain height of the cylinder bore according to the crank angle of the piston. In one embodiment, the region 46 may extend from TDC 42 to a height corresponding to a crank angle of up to 35 degrees. In another embodiment, the region 46 may extend from TDC 42 to a height corresponding to a crank angle of up to 30, 25, 20, 15, or 10 degrees. For example, the region may extend from 0 to 35, 0 to 30, 0 to 25, 0 to 20, 0 to 15, 0 to 10, or 0 to 5 degrees.

Another low honed surface porosity region 46 may extend over a height of the cylinder bore 30 that includes the BDC 44. The region 46 may extend above the BDC 44 by a certain amount. For example, the region 46 may cover a certain height of the cylinder bore according to the crank angle of the piston. In one embodiment, the region 46 may extend from BDC 44 to a height corresponding to a crank angle of at most 145 degrees. In another embodiment, the region 46 may extend from BDC 44 to a height corresponding to a crank angle of at most 150, 155, 160, 165, or 170 degrees. For example, the region may extend from 145 to 180, 150 to 180, 155 to 180, 160 to 180, 165 to 180, 170 to 180, or 175 to 180 degrees.

The high honed surface porosity region 48 may be disposed between the low honed surface porosity regions 46. In one embodiment, the high honed surface porosity region 48 may extend the entire height between the low honed surface porosity regions 46, as shown in FIG. 10. Similar to the low honed surface porosity regions 46, the high honed surface porosity region 48 may cover a certain height of the cylinder bore according to the crank angle of the piston. The range of crank angles may be any range between those disclosed above for the top and bottom low honed surface porosity regions 46. For example, the high honed surface porosity region may extend from a crank angle of 10 to 170 degrees, 15 to 165 degrees, 20 to 160 degrees, 25 to 155 degrees, 30 to 150 degrees, or 35 to 145 degrees, or it may extend at least a portion within any of the above ranges. The top and bottom low honed surface porosity regions 46 may or may not be the same height. Therefore, the crank angle ranges may be asymmetrical and may extend from any value disclosed above for the top region 46 to any region for the bottom region 46. For example, the high honed surface porosity region 48 may extend from a crank angle of 15 to 160 degrees.

Similar to crank angle, the low honed surface porosity region(s) 46 and high honed surface porosity region 48 may cover areas (e.g., height ranges) of the bore surface that correspond to where the piston has a certain velocity. The low honed surface porosity region(s) 46 may correspond to areas or relatively low (or no) velocity, while the high honed surface porosity region 48 may correspond to areas of relatively high (or max) velocity. The velocity of the piston may change depending on the design or configuration of the engine. Accordingly, the areas of the high or low honed surface porosity regions may be described in terms of a percentage of the maximum (max) velocity of the piston.

In one embodiment, the low honed surface porosity region(s) 46 may cover an area of the cylinder bore surface that corresponds to a piston velocity of up to 30% of the max velocity (including zero velocity), for example, up to 25%, 20%, 15%, 10%%, or 5% of the max velocity. As described above, the lower velocities may occur at or near the TDC 42 and/or BDC 44. The high honed surface porosity region 48 may cover the balance of the cylinder bore area. For example, the high honed surface porosity region 48 may cover an area of the cylinder bore surface that corresponds to a piston velocity of at least 5%, 10%, 15%, 20%, 25%, or 30% of the max velocity. In another embodiment, the high honed surface porosity region 48 may cover an area of the cylinder bore surface that corresponds to a piston velocity of 50% to 100% of the max velocity, or any sub-range therein, such as 60% to 100%, 70% to 100%, 80% to 100%, 90% to 100%, or 95% to 100 of the max velocity.

In one embodiment, the honed surface porosity (e.g., average honed surface porosity) of the low honed surface porosity regions 46 may be up to 3%. For example, the low honed surface porosity regions 46 may have a porosity of up to 2.5%, 2%, or 1.5%. In one embodiment, the low honed surface porosity regions 46 may have a honed surface porosity of 0.1% to 3%, or any sub-range therein, such as 0.5% to 3%, 0.5% to 2.5%, 0.5% to 2%, 1% to 2.5%, or 1% to 2%. As disclosed herein, "honed surface porosity" may refer to a surface porosity, or a percentage of the surface of the coating that is made up of pores (e.g., empty space or air, prior to introduction of lubricant).

The porosity of the high honed surface porosity region 48 may be greater than the porosity of the low honed surface porosity region(s) 46. In one embodiment, the high honed surface porosity region 48 may have a honed surface porosity (e.g., average honed surface porosity) of at least 2%, for example, at least 3%, 4%, 5%, 6%, 7%, 8%, 9%, 10%, 15%, or 20%. In another embodiment, the high honed surface porosity region 48 may have a honed surface porosity of 2% to 20%, or any sub-range therein, such as 3% to 20%, 5% to 20%, 10% to 20%, 2% to 15%, 3% to 15%, 5% to 15%, 7% to 15%, 3% to 12%, 3% to 10%, 4% to 10%, 5% to 10%, or 5% to 8%.

The size or diameter of the pores, the pore depth, and/or the pore distribution in the low and high honed surface porosity regions may be the same or may be different. In one embodiment, the mean or average pore sizes of the low honed surface porosity regions 46 and the high honed surface porosity region 48 may be the same or similar. The average pore sizes of the low honed surface porosity regions 46 and the high honed surface porosity region 48 may be from 0.1 to 750 μm, or any sub-range therein, such as 0.1 to 500 μm, 0.1 to 250 μm, 0.1 to 200 μm, 1 to 750 μm, 1 to 500 μm, 1 to 300 μm, 1 to 200 μm, 10 to 300 μm, 10 to 200 μm, 20 to 200 μm, 10 to 150 μm, or 20 to 150 μm.

While the coating 32 on the cylinder bore 30 has been described above with two different honed surface porosity regions, there may be more than two different honed surface porosity regions, such as 3, 4, 5, or more different regions. In some embodiments, instead of discrete regions, there may be a gradient of honed surface porosity along the height of the cylinder bore 30. For example, instead of discrete low honed surface porosity regions 46 and a high honed surface porosity region 48, the honed surface porosity of the coating 32 may increase from the TDC 42 to a peak in a center region of the bore height and then decrease towards the BDC 44. Accordingly, there may be a relative minimum honed surface porosity at or near the TDC 42, a relative maximum honed surface porosity near a center region of the bore height (e.g., at a crank angle around 90 degrees, such as 80 to 100 degrees), and another relative minimum at or near the BDC 44. The change in honed surface porosity may be continuous and may be a linear/constant increase/decrease or may be a curve. The change in honed surface porosity may also be comprised of a plurality of small steps in honed surface porosity having two or more regions (e.g., 2 to N regions). In addition to, or instead of, the honed surface porosity levels of the regions changing as a gradient or a plurality of steps, the pore sizes may also change in a similar manner.

Figure 11:
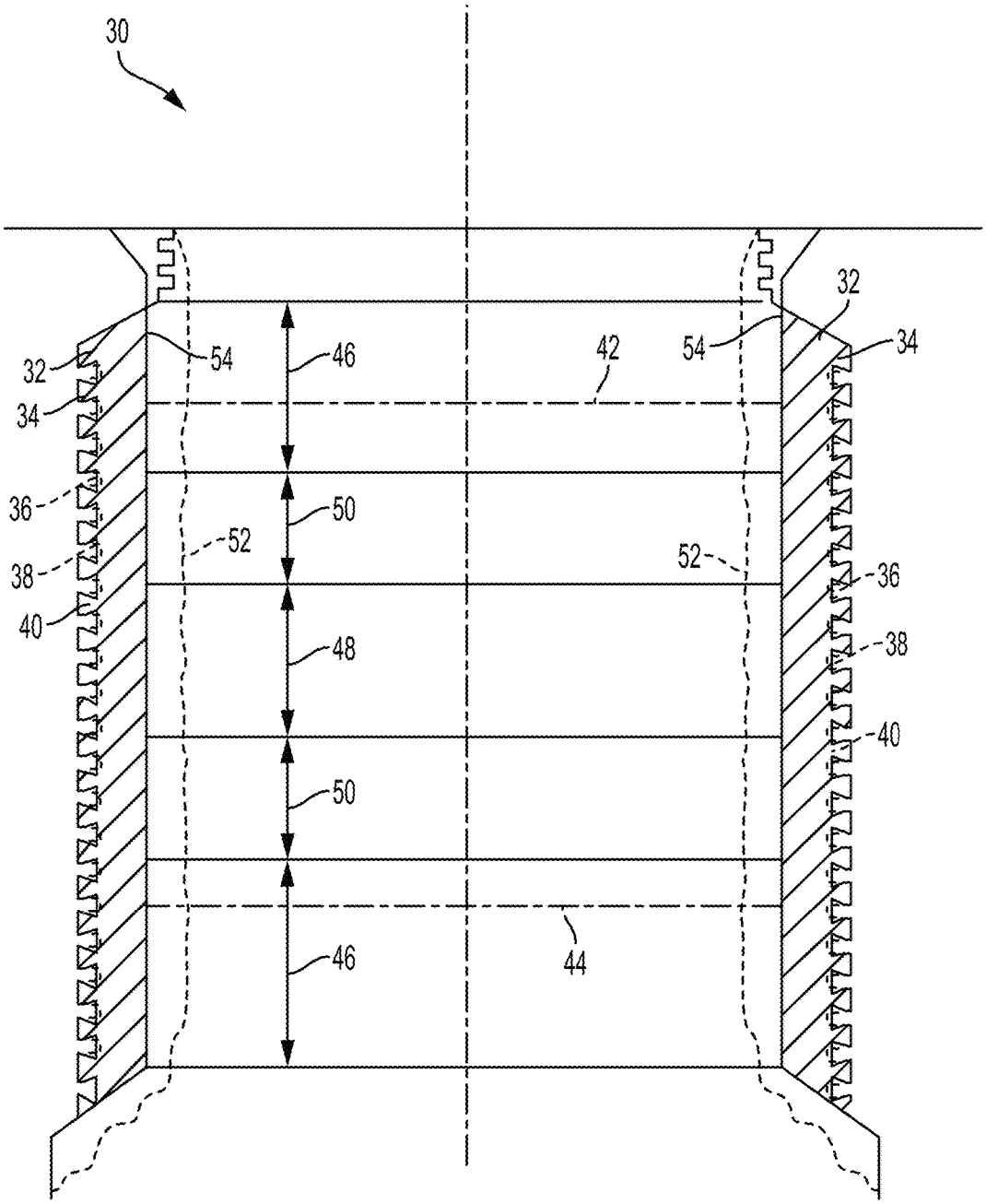
FIG. 11 is another schematic cross-section of a coated engine bore having variable honed surface porosity along a vertical axis of the engine bore, according to an embodiment.

Another example of a cylinder bore 30 having a coating 32 is shown in FIG. 11. Similar to the embodiment shown in FIG. 10, the coating shown in FIG. 4 also has a relatively low honed surface porosity region 46 and a relatively high honed surface porosity region 48. In addition, the coating shown in FIG. 4 may also have an intermediate honed surface porosity region 50, which may have a honed surface porosity level that is between that of the low honed surface porosity region and high honed surface porosity region 48. In the example shown in FIG. 11, there may be two low honed surface porosity regions 46 and a single high honed surface porosity region 48, similar to FIG. 10. However, there may be two intermediate honed surface porosity regions 50, one located or disposed between the low and high honed surface porosity regions along the height of the bore 30. Accordingly, from the TDC 42 to the BDC 44, the order of the regions may be as follows: low-intermediate-high-intermediate-low.

In one embodiment, the low honed surface porosity region(s) 46 and the high honed surface porosity region 48 in FIG. 11 may have the same or similar porosity values as described above for FIG. 10. However, the low and high honed surface porosity regions in FIG. 11 may have different values, for example, the ranges may be narrowed to provide a porosity level gap for the intermediate honed surface porosity regions 50. In one embodiment, the honed surface porosity (e.g., average honed surface porosity) of the intermediate honed surface porosity regions 50 may be from 2% to 7%, or any sub-range therein, such as 2% to 6%, 3% to 7%, 3% to 5%, 4% to 7%, or 4% to 6%. Similar to the description of FIG. 10, the size or diameter of the pores in the low, intermediate, and high honed surface porosity regions may be the same or may be different. The average pore sizes may be the same or similar to those described above. In embodiments where the average pore sizes of the low honed surface porosity regions 46, intermediate honed surface porosity regions 50, and the high honed surface porosity region 48 are different, the average pore size of the intermediate honed surface porosity regions 50 may be between the average pore size of the high honed surface porosity region 48 and the low honed surface porosity regions 46.

In the embodiment shown in FIG. 11, the high honed surface porosity region 48 may extend over a central or middle portion of the cylinder bore height. For example, the high honed surface porosity region 48 may extend over the height of the cylinder bore corresponding to a crank angle of 90 degrees. In one embodiment, the high honed surface porosity region 48 may extend over the height of the cylinder bore corresponding to a crank angle of 60 to 120 degrees, or any sub-range therein, such as 70 to 110 degrees or 80 to 100 degrees, or extend over at least a portion of the ranges above. The low honed surface porosity regions 46 may extend over the same or similar crank angle ranges as described in FIG. 10. Accordingly, the crank angle ranges of the intermediate honed surface porosity regions 50 may be between the ranges for the low and high honed surface porosity ranges.

Similar to above, the low, intermediate, and high honed surface porosity areas may be described in terms of the area or height of the cylinder that corresponds to a piston velocity. Accordingly, the low honed surface porosity region(s) 46 may cover an area of the cylinder bore surface that corresponds to a relatively low piston velocity (e.g., including zero), the high honed surface porosity region(s) 48 may cover an area of the cylinder bore surface that corresponds to a relatively high piston velocity (e.g., including the max velocity), and intermediate honed surface porosity region(s) 50 may cover an area of the cylinder bore surface that corresponds to a piston velocity between that of the low and high velocity areas (e.g., not including zero or the max).

In one embodiment, the low honed surface porosity region(s) 46 may cover an area of the cylinder bore surface that corresponds to a piston velocity of up to 30% of the max velocity (including zero velocity), for example, up to 25%, 20%, 15%, 10%%, or 5% of the max velocity. As described above, the lower velocities may occur at or near the TDC 42 and/or BDC 44. The intermediate honed surface porosity region(s) 50 may cover an area of the cylinder bore surface that corresponds to a piston velocity of 5% to 80% of the max velocity, or any sub-range therein. For example, the intermediate honed surface porosity region(s) 50 may cover an area corresponding to 10% to 80%, 15% to 80%, 20% to 80%, 30% to 80%, 40% to 80%, 30% to 70%, 30% to 60%, 20% to 50%, or 10% to 50% of the max velocity, or others. In one embodiment, the high honed surface porosity region(s) 48 may cover an area of the cylinder bore surface that corresponds to a piston velocity of at least 30%, 40%, 50%, 60%, 70%, or 80% of the max velocity (including max). In another embodiment, the high honed surface porosity region 48 may cover an area of the cylinder bore surface that corresponds to a piston velocity of 50% to 100% of the max velocity, or any sub-range therein, such as 60% to 100%, 70% to 100%, 80% to 100%, 90% to 100%, or 95% to 100 of the max velocity. In one embodiment, the percentage of max velocity of the intermediate honed surface porosity regions 50 may be between and/or form the balance of the ranges for the low and high honed surface porosity ranges.

The coating 32 may be a single layer or may be formed of multiple layers. For example, if the coating 32 is applied using a thermal spray method (e.g., PTWA), there may be multiple layers sprayed onto the bore surface to build up the coating 32 to its final thickness. The thermal spray may be applied by a rotating nozzle or by rotating the bore surface around a stationary nozzle. Accordingly, each revolution of the nozzle and/or bore surface may deposit a new layer when forming the coating 32. As described above, the honed surface porosity levels (e.g., the low, intermediate, or high honed surface porosity regions) may be surface porosity levels. However, there may also be variation in the porosity as a function of the depth of the coating 32. For example, as described above, the disclosed cleaning and honing process may increase the honed surface porosity above the bulk porosity of the coating after the coating has been deposited. In one embodiment, the disclosed process may increase the honed surface porosity by at least 1% compared to the previous surface porosity and/or the bulk porosity of the coating (e.g., average porosity). For example, the disclosed process may increase the honed surface porosity by at least 2%, 3%, 4%, 5%, 6%, or more. In one embodiment, the disclosed process may increase the honed surface porosity by 1-10%, or any sub-range therein, such as 2-10%, 3-10%, 5-10%, 1-8%, 2-8%, 1-6%, 1-5%, 2-5%, 1-4%, or 2-4%.

Figure 12:
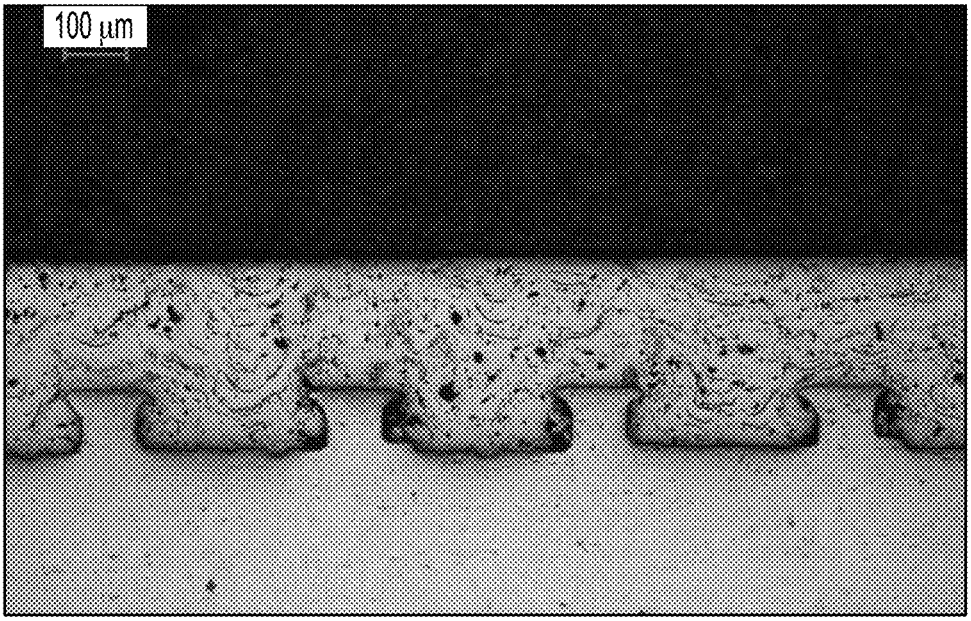
FIG. 12 is a micrograph of a polished metallographic cross-section of a moderate porosity coating.
Figure 13:
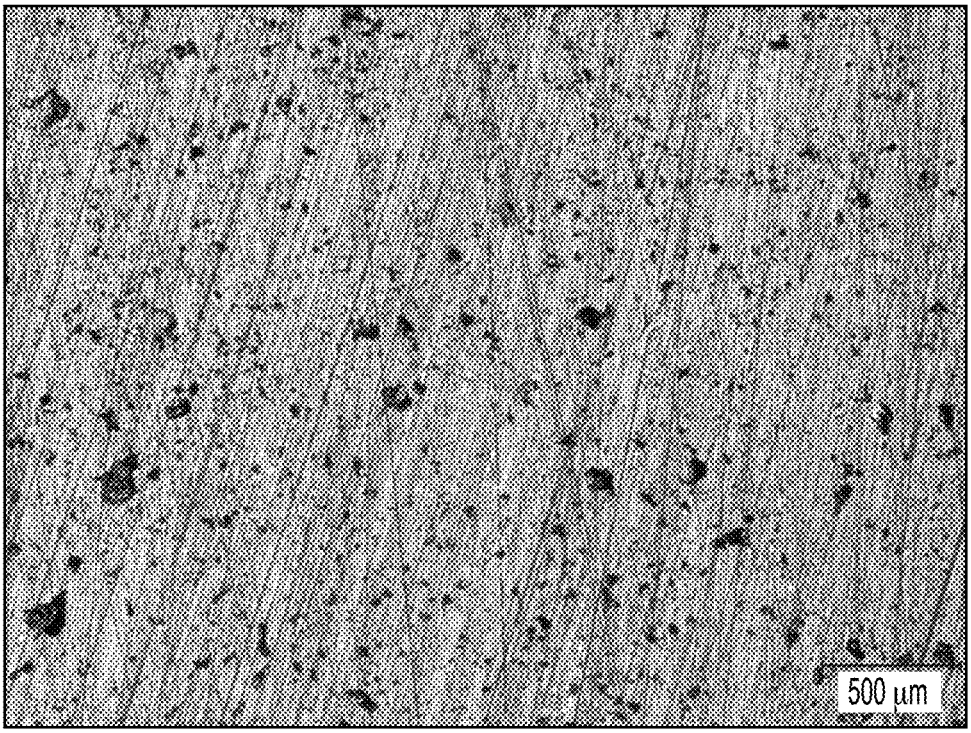
FIG. 13 is a micrograph of a honed surface of the moderate porosity coating of FIG. 12 having an increased porosity.

With reference to FIGS. 12-15, comparisons of different coating surfaces are shown. FIG. 12 shows a polished metallographic cross section of a coating for a relatively moderate porosity coating. As shown and described with reference to FIG. 5, it has been found that conventional honing processes may cause a honed surface to have a reduced porosity relative to the bulk (e.g., cross-section). The polished surface shown in FIG. 12 has a porosity of 4.30%. FIG. 13 shows a honed surface for an identical coating to that of FIG. 12, but with the disclosed cleaning and honing process performed. The honed surface of FIG. 13 has a porosity of 7.39%. Accordingly, the disclosed process increased the porosity of the coating surface.

Figure 14:
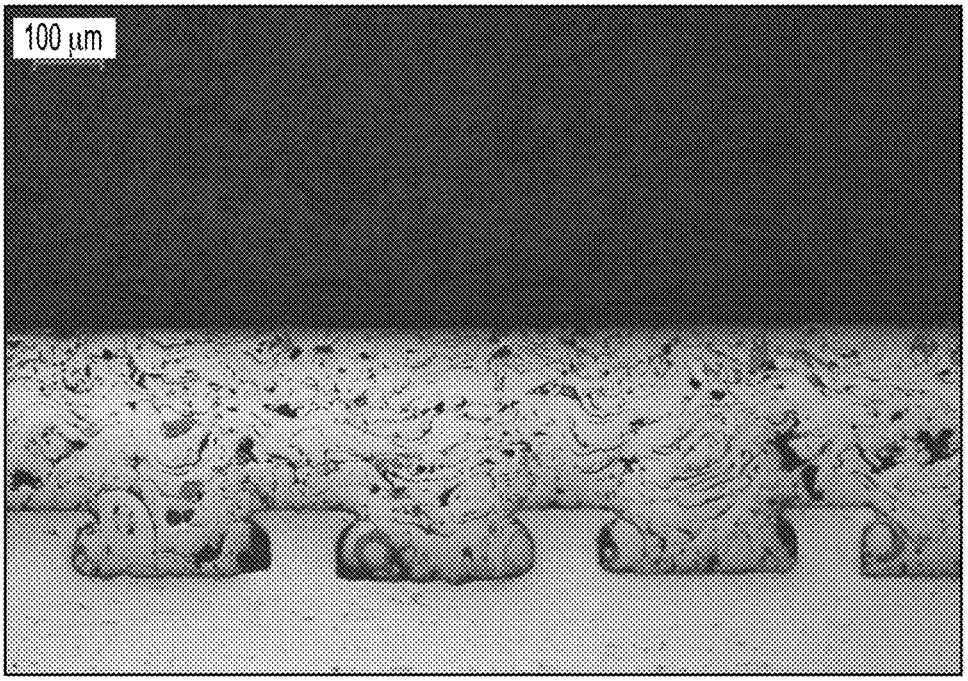
FIG. 14 is a micrograph of a polished metallographic cross-section of a relatively high porosity coating.
Figure 15:
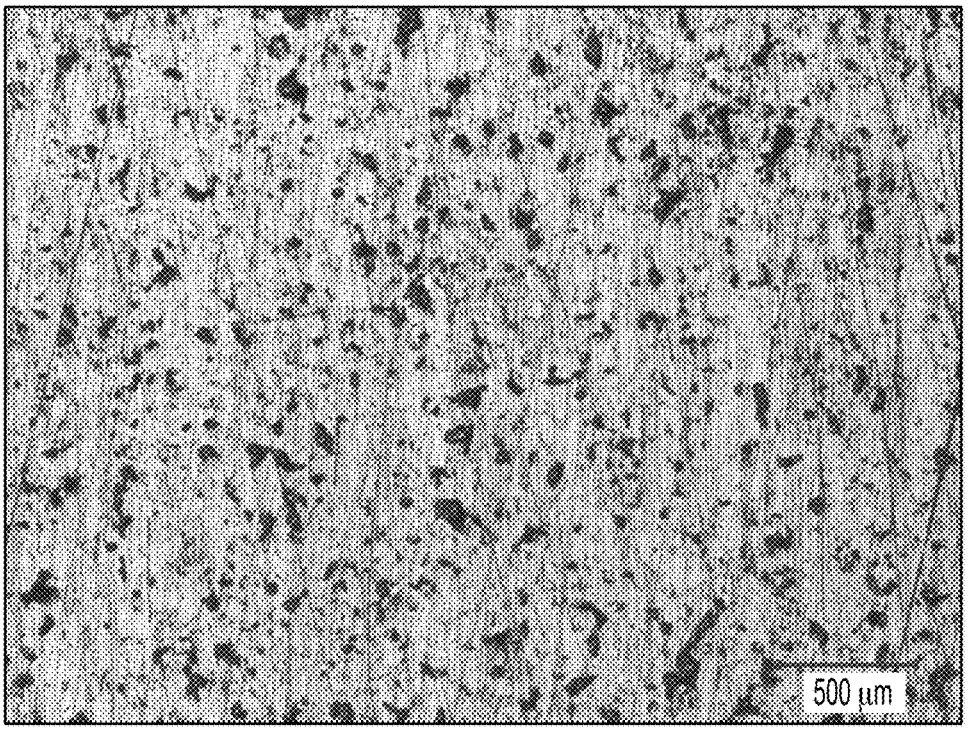
FIG. 15 is a micrograph of a honed surface of the relatively high porosity coating of FIG. 14 having an increased porosity.

FIG. 14 shows a polished coating surface for a relatively high porosity coating (e.g., as described in U.S. application Ser. No. 15/064,903) that received a conventional honing process. The polished surface shown in FIG. 14 has a porosity of 5.85%. FIG. 15 shows a honed surface for an identical coating to that of FIG. 14, but with the disclosed cleaning and honing process performed. The honed surface of FIG. 15 has a porosity of 12.22%. Accordingly, the disclosed process greatly increased the porosity of the coating surface for the relatively high-porosity coating.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method, comprising:

spraying a coating having an initial average bulk porosity onto an engine bore wall;

honing the coating to create an intermediate honed surface;

cleaning the intermediate honed surface; and honing the intermediate honed surface with a cutting force of 110-130 kgf after the cleaning step to create a honed surface having an average porosity greater than the initial average bulk porosity.

2. The method of claim 1, wherein honing the intermediate honed surface creates a honed surface having an average porosity that is at least 2% greater than the initial average bulk porosity.

3. The method of claim 1, wherein honing the intermediate honed surface creates a honed surface having an average porosity that is at least 5% greater than the initial average bulk porosity.

4. The method of claim 1, wherein the cleaning step generates nucleation sites in the intermediate honed surface and honing the intermediate honed surface after the cleaning step removes material from the nucleation sites to create new pores.

5. The method of claim 1, wherein the cleaning step includes spraying a pressurized liquid or a solid onto the intermediate honed surface or brushing the intermediate honed surface.

6. The method of claim 1, wherein the cutting force is 115-125 kgf.

7. The method of claim 1, wherein the cutting force is about 120 kgf.

8. The method of claim 1, wherein the initial average bulk porosity is from 0.1-3% and the average porosity of the honed surface is 5-20%.

9. A method, comprising:

spraying a coating comprising a plurality of particles onto an engine bore wall, the coating having an initial average bulk porosity;

honing the coating to create an intermediate honed surface;

cleaning the intermediate honed surface to remove debris from pores in the intermediate honed surface and to loosen a portion of the particles in the coating; and honing the intermediate honed surface after the cleaning step to remove particles loosened in the cleaning step and create a honed surface having an average porosity greater than the initial average bulk porosity.

10. The method of claim 9, wherein honing the intermediate honed surface creates a honed surface having an average porosity that is at least 2% greater than the initial average bulk porosity.

11. The method of claim 9, wherein honing the intermediate honed surface creates a honed surface having an average porosity that is at least 5% greater than the initial average bulk porosity.

12. The method of claim 9, wherein the cleaning step includes spraying a pressurized liquid onto the intermediate honed surface.

13. The method of claim 9, wherein the cleaning step includes spraying a solid material onto the intermediate honed surface.

14. The method of claim 9, wherein the cleaning step includes mechanically brushing the intermediate honed surface.

15. The method of claim 9, wherein the honing of the intermediate honed surface is performed using a cutting force of 110-130 kgf.

16. The method of claim 15, wherein the cutting force is 115-125 kgf.

17. The method of claim 9, wherein the initial average bulk porosity is from 0.1-3% and the average porosity of the honed surface is 5-20%.

18. The method of claim 1, wherein the engine bore wall is formed of aluminum.

19. The method of claim 9, wherein the engine bore wall is formed of aluminum.

20. The method of claim 15, wherein the cutting force is 120 kgf.

* * * * *